US006278104B1

(12) United States Patent
Saldana et al.

(10) Patent No.: US 6,278,104 B1
(45) Date of Patent: Aug. 21, 2001

(54) POWER SUPPLY FOR NIGHT VIEWERS

(75) Inventors: Michael R. Saldana, New Braunfels, TX (US); Michael J. Iouse, Phoenix, AZ (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/409,240

(22) Filed: Sep. 30, 1999

(51) Int. Cl.[7] ..... H01J 40/14
(52) U.S. Cl. ..... 250/214 VT; 250/214 R
(58) Field of Search ..... 250/214 VT, 214 R, 250/214 RC, 214 C, 214.1; 313/103 R, 105 CM, 524, 528, 537, 542–544

(56) References Cited

U.S. PATENT DOCUMENTS

| | | | |
|---|---|---|---|
| 4,037,132 | 7/1977 | Hoover | 250/214 VT |
| 5,146,077 | 9/1992 | Casterta et al. | 250/214 VT |
| 5,528,483 * | 6/1996 | Mohandes | 363/21 |
| 5,942,747 | 8/1999 | Saldana | 250/214 VT |

OTHER PUBLICATIONS

PCT Publication No. WO 99/05695, Night Vision Device Having Improved Automatic Brightness Control, U.S.A., Feb. 1999.

PCT Publication No. WO 99/05697, Night Vision Device Having Improved Automatic Brightness Control, U.S.A., Feb. 1999.

* cited by examiner

*Primary Examiner*—Que T. Le
(74) *Attorney, Agent, or Firm*—Marsteller & Associates, P.C.

(57) ABSTRACT

A night vision device (10) includes an improved power (62) that regulates the output brightness of the image intensifier tube (14) of the device (10) according to the two functions of MCP voltage control and photocathode gating duty cycle control. These two functions operate in sequence—the MCP voltage control operates prior to the duty cycle control with increasing input illumination to the image intensifier—in order to provide automatic brightness control and bright source protection while maximizing the high light level image resolution and maintaining the signal-to-noise ratio of the image intensifier at an acceptably high level.

28 Claims, 5 Drawing Sheets

FIG. 1.
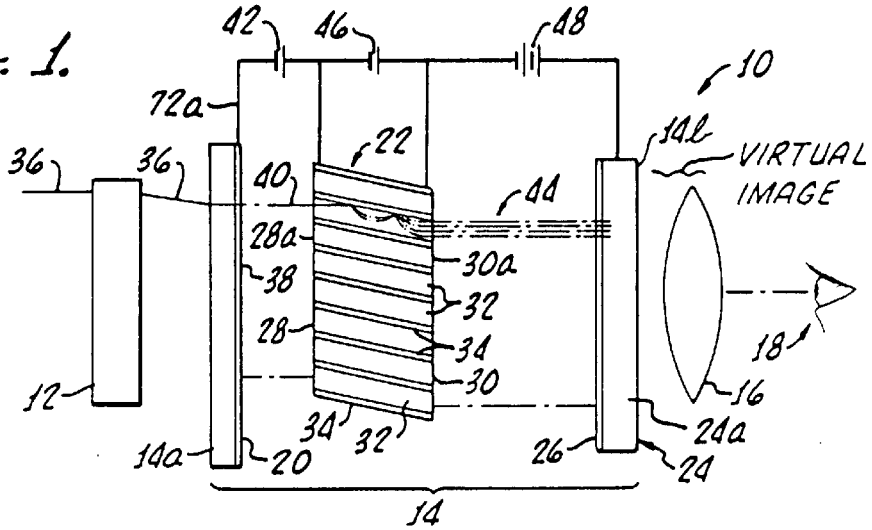
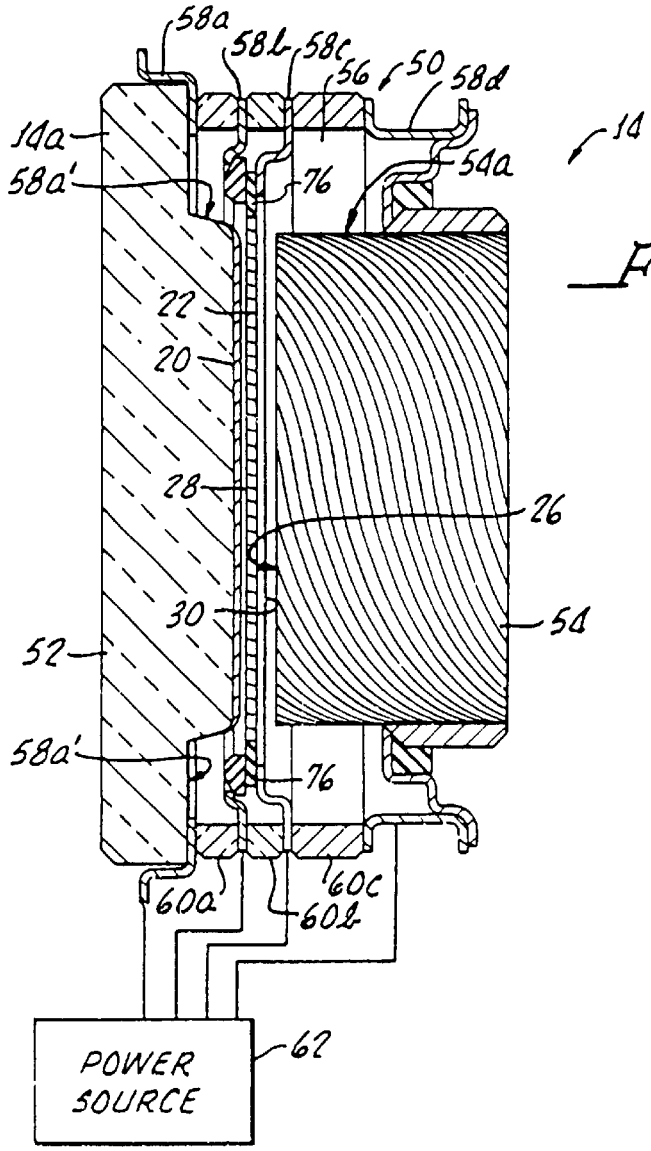
FIG. 2.

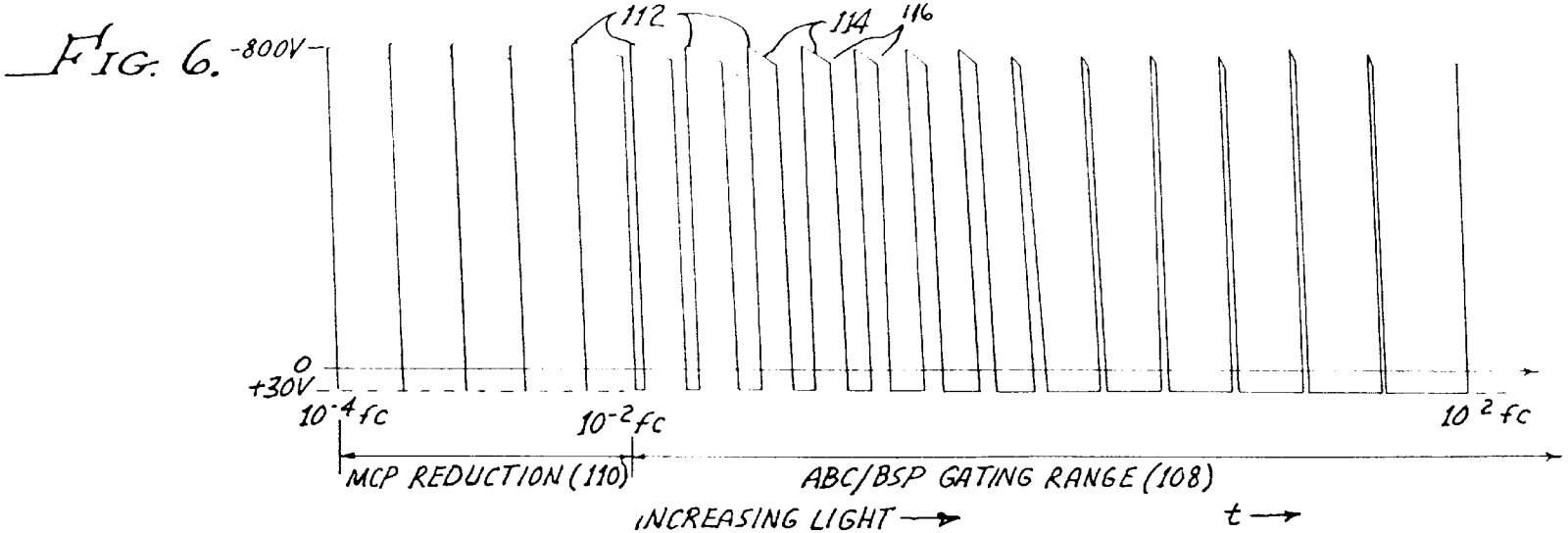
FIG. 6.
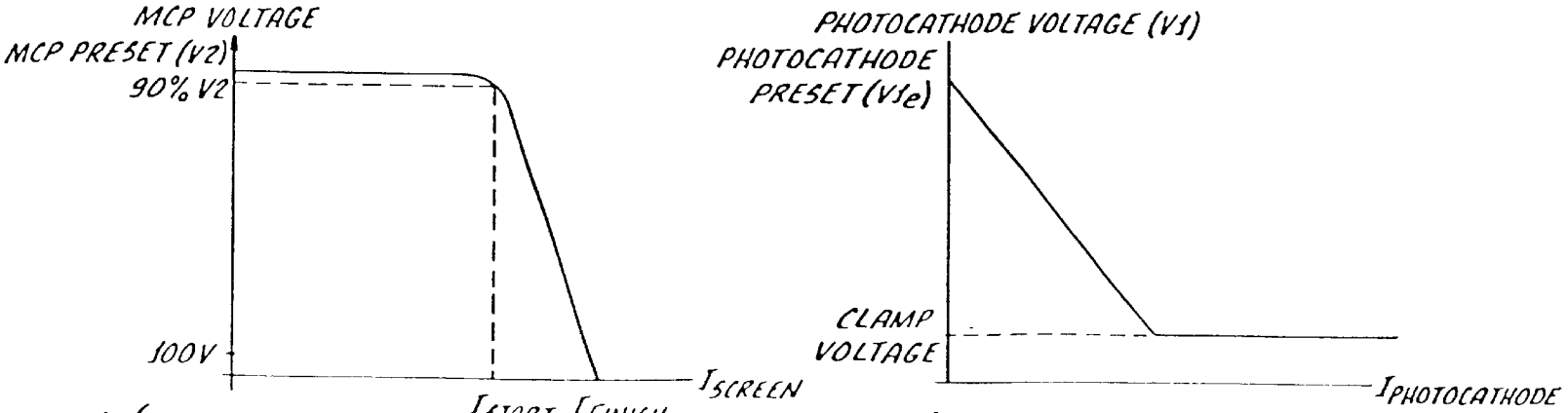
FIG. 10. (PRIOR ART)
FIG. 11. (PRIOR ART)

POWER SUPPLY FOR NIGHT VIEWERS

FIELD OF THE INVENTION

The present invention is generally in the field of night vision devices of the light amplification type. More particularly, the present invention relates to an improved night vision device having an image intensifier tube ($I^2T$) and an unproved power supply for the $I^2T$ which operates the tube in a unique way to achieve both improved automatic brightness control and improved bright-source protection. A method of operating the $I^2T$ and a method of operating the improved power supply are disclosed also.

BACKGROUND OF THE INVENTION

Even on a night which is too dark for diurnal vision, invisible infrared light is richly provided by the stars. Human vision cannot utilize this infrared night time light from the stars because the so-called near-infrared portion of the spectrum is invisible for humans. A night vision device of the light amplification type can provide a visible image replicating the night time scene. Such night vision devices generally include an objective lens which focuses invisible infrared light from the night time scene onto the transparent light-receiving face of an $I^2T$. At its opposite image-face, the image intensifier tube provides an image in visible yellow-green phosphorescent light, which is then presented to a user of the device via an eye piece lens.

A contemporary night vision device will generally use an $I^2T$ with a photocathode behind the light-receiving face of the tube. The photocathode is responsive to photons of infrared light to liberate photoelectrons. These photoelectrons are moved by a prevailing electrostatic field to a microchannel plate having a great multitude of dynodes, or microchannels, with an interior surface substantially defined by a material having a high coefficient of secondary electron emissivity. The photoelectrons entering the microchannels cause a cascade of secondary emission electrons to move along the microchannels so that a spatial output pattern of electrons which replicates an input pattern, and at a considerably higher electron density than the input pattern results. This pattern of electrons is moved from the microchannel plate to a phosphorescent screen by another electrostatic field to produce a visible image.

A power supply for the $I^2T$ provides the electrostatic field potentials referred to above, and also provides a field and current flow to the microchannel plate(s). Conventional night vision devices (i.e., since the 1970's and to the present day) provide automatic brightness control (ABC), and bright source protection (BSP). The former function maintains the brightness of the image provided to the user substantially constant despite changes in the brightness (in infrared and the near-infrared portion of the spectrum) of the scene being viewed. BSP prevents the photocathode from being damaged by an excessively high current level in the event that a bright source, such as a flare or fire, comes into the field of view.

The ABC function is accomplished by providing a regulator circuit monitoring the output current from the phosphorescent screen (See FIG. 9). When this current exceeds a certain threshold, the field voltage level across the opposite faces of the microchannel plate(s) is decreased to reduce the gain of the microchannel plate(s), as is graphically depicted in FIG. 10.

A bright source protection feature is also provided in conventional night vision devices by decreasing the field voltage provided to the photocathode as a function of cathode current down to a predetermined threshold voltage commonly referred to as clamp voltage, a voltage level that is slightly greater than the minimum voltage required to allow photoelectrons to penetrate the ion barrier film that is deposited on the front face of the microchannel plate. This is accomplished through the use of a high value resistor between the cathode voltage multiplier in the power supply and the photocathode that creates a greater voltage drop under the high current conditions caused by a large number of photons incident on the photocathode (with a resulting high number of photoelectrons being provided by the photocathode). The photoelectrons provided by the photocathode represent a current flow increasing in magnitude with increasing light levels in the viewed field, such that the impedance of circuit element causes a decrease in the voltage level effective at the photocathode to move these electrons to the microchannel plate(s).

Recalling FIG. 9, it will be noted that this circuit architecture requires the use of two transformers, which are relatively large and heavy components of the circuit. Further, is seen that a typical conventional circuit architecture for a power supply of a night vision device provides a high-value resistor (generally 1–18 G-ohm) to the output of the photocathode voltage multiplier and a clamping circuit consisting of a voltage source and a low-leakage, high-voltage diode. As photocathode current flows through the high-value resistor, the photocathode voltage will decrease linearly until it reaches a voltage equal to the voltage source (plus the high-voltage low-leakage diode voltage drop). See FIG. 11 for a graphical illustration of this BSP voltage relationship at the photocathode. This voltage is commonly referred to as a clamp voltage, and is typically between 30 and 40 volts D.C.

The conventional method of BSP also has a disadvantage of decreased resolution for the $I^2T$. The reduced electrostatic field between the photocathode and the microchannel plate (s) input causes a reduced resolution for the tube. That is, photoelectrons liberated from the photocathode are not moved to the MCP as quickly under the reduced electrostatic field, this allows for lateral spreading of the photoelectrons and a loss of image definition. This is due to the fact that each photoelectron is emitted with some radial (or lateral) velocity component which is imparted to the electron during the photo-emission process. This radial velocity component causes the electron to move laterally away from the emission site at a constant rate which is independent of the magnitude of the electrostatic field between the photocathode and the microchannel plate. It can be readily appreciated, that the time required to transit the gap between the photocathode and microchannel plate will be increased under a reduced electrostatic filed. This increase in transit time allows for more lateral spreading and a commensurate reduction in resolution. Although this method of BSP serves to protect the photocathode from damage due to excess current densities, it will result in greatly reduced performance of the $I^2T$ at high light levels ($10^{-2}$ foot-candles and greater).

SUMMARY OF THE INVENTION

In view of the deficiencies of the conventional related technology, it would be desirable to provide a power supply for an $I^2T$ which provides ABC and BSP functions without the loss of performance at high light levels.

An advantage for such an improved power supply could be realized if a combination of MCP voltage reduction and photocathode voltage gating were employed. The MCP voltage reduction could be used for regulating the phosphor screen current for a portion of the high light level range wherein a means of overall $I^2T$ gain reduction is necessary in order to regulate the output brightness of the screen (commonly referred to as ABC range, and is typically on the order of from about $10^{-4}$ to 20 foot candles). The photocathode voltage gating could be used for the remaining portion of the ABC range and would not only serve to regulate the output brightness of the $I^2T$ but would also serve to regulate the time-averaged photocathode current at a low level thus preventing damage due to excess current density. It should be appreciated that the sequence of the two events of MCP voltage reduction and the photocathode duty cycle reduction presented here is distinguished from that presented in Ser. No. 08/901,419, filed on Jul. 28, 1997, in that it is reversed. This very subtle difference, although seemingly unimportant, is of high importance in the performance of the image intensifier operated with this power supply. At input light levels in the range near the beginning of the ABC range, where the signal level from the viewed seen available to photocathode is still quite low, the sequence of events provided here maximizes signal-to-noise ratio (SNR) of the image intensifier by maximizing the time-averaged photocathode current by keeping the photocathode gating duty cycle at substantially 100% (accomplishing ABC operation in this regime by the reduction of MCP voltage). It is recalled that the method described in Ser. No. 081901,419, filed on Jul. 28, 1997, teaches to reduce the photocathode duty cycle before reducing the MCP voltage which, in the input light level range near the beginning of the ABC range, results in reduced SNR due to the loss of time-averaged photocathode signal. Accordingly it is an object for this invention to provide an improved power supply for an $I^2T$ which avoids one or more of the deficiencies of the related conventional technology Another object for this invention is to provide such an improved power supply for an $I^2T$ which realizes one or more of the advantages set out above.

Yet another objective for this invention is to provide a method of operating such an improved power supply for an $I^2T$.

Another objective for this invention is to provide a method of operating an $I^2T$.

Still another objective for this invention is to provide a night vision device having such an improved power supply.

An advantage of the improved power supply for an $I^2T$ is that a night vision device using such a power supply does not experience the loss of resolution in bright field conditions which is common with conventional night vision devices. In fact, resolution and signal-to-noise ratio of the image intensifier are all preserved at desirably high levels throughout the ABC and BSP operations of the tube and power supply, which is not the case with conventional $I^2T$ power supplies. Fixed pattern noise is preserved at a low level with the present invention. Additionally, mean time between failures for the power supply may be improved in comparison to conventional power supplies because parts counts may be reduced.

A further advantage of the present inventive power supply is that the photocathode experiences only the full designed voltage level during its on times and does not experience clamp voltage, a mode in which tube performance is degraded dramatically. Effectively, gating of the photocathode voltage "simulates low-light conditions" for the $I^2T$ by regulating the time-averaged photocathode current by reducing the duty cycle of the of the gating, and keeps the components of the $I^2T$ operating under the ideal conditions of low current densities that they were designed for.

Other objects, features, and advantages of the present invention will be apparent to those skilled in the art from a consideration of the following detailed description of a preferred exemplary embodiment thereof taken in conjunction with the associated figures which will first be described briefly.

BRIEF DESCRIPTION OF THE DRAWINGS

FIG. 1 is a schematic representation of a night vision device embodying the present invention;

FIG. 2 shows an $I^2T$ in longitudinal cross section, with an associated power supply embodying the present invention;

FIGS. 4–8 respectively provide graphical representations of photocathode peak voltage, duty cycle, voltage wave form, microchannel plate voltage, and $I^2T$ output brightness;

FIGS. 9–11 respectively provide a schematic circuit illustration, and graphical representations of microchannel plate voltage and photocathode voltage for a conventional $I^2T$ power supply.

DETAILED DESCRIPTION OF AN EXEMPLARY PREFERRED EMBODIMENT OF THE INVENTION

Figure 3:
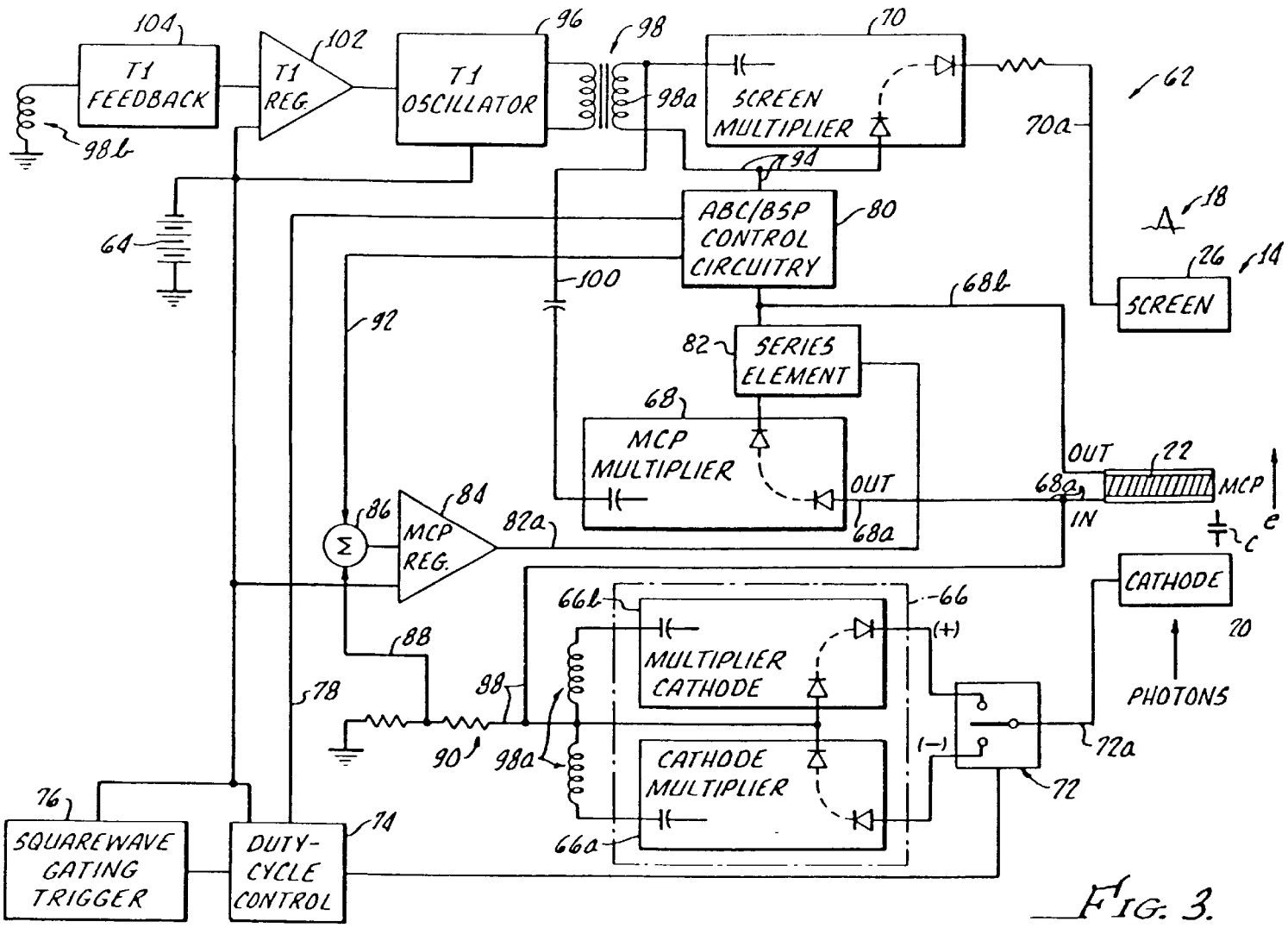
FIG. 3 is a schematic representation of an improved power supply for an $I^2T$ embodying the present invention.

While the present invention may be embodied in many different forms, disclosed herein is a specific exemplary embodiment that illustrates and explains the principles of the invention It should be emphasized that the present invention is not limited to the specific embodiment illustrated.

Referring first to FIG. 1, there are shown schematically the basic elements of one version of a night vision device 10 of the light amplification type. Night vision device 10 generally comprises a forward objective optical lens assembly 12 (illustrated schematically as a functional block element—which may include one or more lens elements). This objective lens 12 focuses incoming light from a distant night-time scene on the front light-receiving end 14*a* of an $I^2T$ 14 (as will be seen, this surface is defined by a transparent window portion of the tube—to be further described below). As was generally explained above, the $I^2T$ provides an image at light output end 14*b* in phosphorescent yellow-green visible light which replicates the night-time scene. This night time scene would generally be not visible (or would be only poorly visible) to a human's diurnal vision. This visible image is presented by an eye piece lens illustrated schematically as a single lens 16 producing a virtual image of the rear light-output end of the tube 14 at the user's eye 18.

More particularly, $I^2T$ 14 includes a photocathode 20 which is responsive to photons of infrared light to liberate photoelectrons, a microchannel plate 22 which receives the photoelectrons in a pattern replicating the night-time scene, and which provides an amplified pattern of electrons also replicating this scene, and a display electrode assembly 24. In the present embodiment the display electrode assembly 24 may be considered as having an aluminized phosphor coating or phosphor screen 26. When this phosphor coating is impacted by the electron shower from microchannel plate 22, it produces a visible image replicating the pattern of the electron shower. Because the electron shower pattern still replicates the scene viewed via lens 12, a user of the device can effectively seen in the dark, by only star light or other low-level illumination. A transparent window portion 24*a* of the assembly 24 conveys the image from screen 26 outwardly of the tube 14 so that it can be presented to the user 18.

Alternatively, as those ordinarily skilled in the pertinent arts will know, the output electrode assembly may include a charge coupled device (CCD), a CMOS sensor, or other similar device providing an image. In this case, the reference numeral 26 would indicate such a CCD or similar device, with the output of the image intensifier tube being in the form of an image signal from this CCD or similar device. The user of such a device would view the image information on a display, such as a liquid crystal display, or cathode ray tube. For purposes of this description of the present invention, the "screen" term shall include the alternative receiver elements, such as a CCD.

Still more particularly, microchannel plate 22 is located just behind photocathode 20, with the microchannel plate 22 having an electron-receiving face 28 and an opposite electron-discharge face 30. This microchannel plate 22 further contains a plurality of angulated microchannels 32 which open on the electron-receiving face 28 and on the opposite electron-discharge face 30. Microchannels 32 are separated by passage walls 34. The display electrode assembly 24, generally has a conductive coated phosphor screen 26, is located behind microchannel plate 22 with phosphor screen 26 in electron line-of-sight communication with the electron-discharge face 30. Display electrode assembly 24 is typically formed of an aluminized phosphor screen 26 deposited on the vacuum-exposed surface of the optically transparent material of window portion 24*a*. The focusing eye piece lens 16 is located behind the display electrode assembly 24 and allows an observer 18 to view a correctly oriented image corresponding to the initially received low-level image.

As will be appreciated by those skilled in the art and also viewing now FIG. 2, the individual components of $I^2T$ 14 are all mounted and supported in a tube or chamber (to be further explained below) having forward and rear transparent plates cooperating to define a chamber which has been evacuated to a low pressure. This evacuation allows electrons liberated into the free space within the tube to be transferred between the various components by prevailing electrostatic fields without atmospheric interference that could possibly decrease the signal-to-noise ratio.

As indicated above, photocathode 20 is mounted immediately behind objective lens 12 on the inner vacuum-exposed surface of the window portion of the tube and before microchannel plate 22. Typically, this photocathode 20 is a circular disk-like structure having a predetermined construction of semiconductor materials, and is mounted on a substrate in a well known manner. Suitable photocathode materials are generally semi-conductors such as gallium arsenide; or alkali metals, such as compounds of sodium, potassium, cesium, and antimony (commercially available as S-20), carried on a readily available transparent substrate. A variety of glass and fiber optic substrate materials are commercially available.

Considering in somewhat greater detail the operation of the $I^2T$ 14, it is seen that in response to photons 36 entering the forward end of night vision device 10 and passing through objective lens 12, photocathode 20 has an active surface 38 from which are emitted photoelectrons in numbers proportionate to and at locations replicative of the received optical energy of the night-time scene being viewed. In general, the image received will be too dim to be viewed with human natural vision, and may be entirely or partially of infrared radiation which is invisible to the human eye. It is thus understood that the shower of photoelectrons emitted from the photocathode are representative of the image entering the forward end of $I^2T$ 14. The path of a typical photoelectron emitted from the photon input point on the photocathode 20 is represented in FIG. 1 by dashed line 40.

Photoelectrons 40 emitted from photocathode 20 gain energy through an electric field of predetermined intensity gradient established between photocathode 20 and electron-receiving face 28, which field gradient is provided by power source 42. Typically, power source 42 will apply an electrostatic voltage on the order of 200 to 800 volts to create a field of the desired intensity. After accelerating over a distance between the photocathode 20 and the input surface 28 of the microchannel plate 22, these photoelectrons 40 enter microchannels 32 of microchannel plate 22. As will be discussed in greater detail below, the photoelectrons 40 are amplified by emission of secondary electrons to produce a proportionately larger number of electrons upon passage through microchannel plate 22. This amplified shower of secondary-emission electrons 44, also accelerated by a respective electrostatic field generated by power source 46, then exits microchannels 32 of microchannel plate 22 at electron-discharge face 30.

Once in free space again, the amplified shower of photoelectrons and secondary emission electrons is again accelerated in an established electrostatic field provided by power source 48. This field is established between the electron-discharge face 30 and display electrode assembly 24. Typically, the power source 48 produces a voltage or potential on the order of 3,000 to 7,000 volts, and more preferably on the order of 6,000 volts in order to impart the desired energy to the multiplied electrons 44.

The shower of photoelectrons and secondary-emission electrons 44 (those ordinarily skilled in the art will know that considered statistically, the shower 44 is almost or entirely devoid of photoelectrons and is made up entirely or almost entirely of secondary emission electrons. Statistically, the probability of a photoelectron avoiding absorption in the microchannels 32 is low). However, the shower 44 is several orders of magnitude more intense than the initial shower of photoelectrons 40, but is still in a pattern replicating the image focused on photocathode 20. This amplified shower of electrons falls on the phosphor screen 26 of display electrode assembly 24 to produce an image in visible light.

Viewing FIG. 2 in greater detail, the $I^2T$ 14 is seen to include a tubular body 50, which is closed at opposite ends by a front light-receiving window 52, and by a rear fiber-optic image output window 54. The window 54 defines the light output surface 14*b* for the tube 14, and carries the coating 26, as will be further described. As is illustrated in FIG. 2, the rear window 54 may be an image-inverting type (i.e., with optical fibers bonded together and rotated 1800 between the opposite faces of this window 54 in order to provide an erect image to the user 18. The window member 54 is not necessarily of such inverting type. Both of the windows 52 and 54 are sealingly engaged with the body 50, so that an interior chamber 56 of the body 50 can be maintained at a vacuum relative to ambient. The tubular body 50 is made up of plural metal rings, each indicated with the general numeral 58 with an alphabetical suffix added thereto (i.e., 58*a*, 58*b*, 58*c*, and 58*d*) as is necessary to distinguish the individual rings from one another.

The tubular body sections 58 are spaced apart and are electrically insulated from one another by interposed insulator rings, each of which is indicated with the general numeral 60, again with an alphabetical suffix added thereto (i.e., 60*a*, 60*b*, and 60*c*). The sections 58 and insulators 60 are sealingly attached to one another. End sections 58*a* and 58*d* are likewise sealingly attached to the respective windows 52 and 54. Those ordinarily skilled in the pertinent arts will know that the body sections 58 are individually connected electrically to a power supply 62 (which provides sources 42, 46, and 48, as described above), and which is effective during operation of the $I^2T$ 14 to maintain an electrostatic field most negative at the section 58*a* and most positive at the section 58*d*.

Further viewing FIG. 2, it is seen that the front window 52 carries on its rear surface within the chamber 56 the photocathode 20. The section 58*a* is electrically continuous with the photocathode by use of a thin metallization (indicated with reference numeral 58*a*') extending between the section 58*a* and the photocathode 20. Thus, the photocathode by this electrical connection and because of its semi-conductive nature, has an electrostatic charge distributed across the areas of this disk-like photocathode structure. Also, a conductive coating or layer is provided at each of the opposite faces 28 and 30 of the microchannel plate 22 (as is indicated by arrowed numerals 28*a* and 30*a*). Power supply 46 is conductive with these coatings by connection to housing sections 58*b* and 58*c*. Finally, the power supply 48 is conductive with a conductive layer or coating (possibly an aluminum metallization, as mentioned above) at the display electrode assembly 24 by use of a metallization also extending across the vacuum-exposed surfaces of the window member 54, as is indicated by arrowed numeral 54*a*.

It should be noted in considering the description below of the structure and operation of the power supply 62, that the term "image intensifier tube" is used in a generic sense. Those ordinarily skilled in the pertinent arts will appreciate that the tube being powered may be configured as an electron multiplier tube in which the output is an electrical signal rather than a visible image. Also, the tube being powered may be of the photodetector, phosphorescence detector, or scintillation detector type, in which the output is also an electrical signal rather than a visible image. Such tubes are generally used, for example, to detect a phosphorescent response in a chemical reagent exposed to exciting light of another color or wavelength, or in a detector for high-energy events having as a result of their occurrence the production of a small number of photons (i.e., as few as one photon per event).

Such application of tubes having a photocathode and a dynode (either of microchannel plate configuration with many dynodes, or of another configuration with one or more dynodes) may experience some or all of the difficulties in operation which are described above in the context of night vision devices. Accordingly, it will be appreciated that a power supply embodying principles of this invention may be used in such applications.

Considering now FIG. 3, it is seen that the power supply 62 includes a power source, which in this case is illustrated as a battery 64. It will be appreciated that a battery 64 is generally used as the power source for portable apparatus, such as night vision devices. However, the invention is not limited to any particular power source. For example, a regulated line-power source could be used to provide input power to a power supply implementing and embodying the principles of the present invention. Considered generally, the power supply 62 includes three voltage multipliers or voltage converters, respectively indicated with the numerals 66, 68, and 70. The voltage converter 66 for the photocathode 20 includes two converters of differing voltage level, and indicated with the numerals 66*a* and 66*b* (note that the converter 66*b* provides a voltage level which is positive with respect to the face 28 of MCP 22, while converter 66*a* provides a voltage level which is negative relative to the face 28 of the MCP 22. A tri-stable switching network 72 switches controllably between alternative positions either conducting the photocathode 20 to voltage converter 66*a,* to an open circuit position, or to voltage converter 66*b,* all via the conductive connection 72*a* A duty cycle control 74 controls the switching position of the switching network 72, and receives as inputs a square wave gating trigger signal from an oscillator 76, and a control signal via a conductor 78 from an ABC/BSP control circuit 80. It will be appreciated that the switching network 72 may be configured to switch (i.e., to toggle) between voltage sources 66*a* and 66*b* without having an open-circuit condition. This alternative would yield essentially a square-wave voltage on the graph of FIG. 6.

Power supply to the microchannel plate 22 (that is, to the conductive layers or metallizations 28*a* and 30*a*) is effected from the voltage converter 68 via connections 68*a* and 68*b*. Interposed in connection 68*b* is a series element 82, which in effect is a variable resistor. A high-voltage MOSFET may be used for element 82, and the resistance of this element is controlled over a connection 82*a* by a regulator circuit 84. Regulator circuit 84 receives a feed back control signal from a summing junction 86, which receives an input from conductor 88 via a level-adjusting resistor 90, and also receives an input via conductor 92 from the ABC/BSP control circuit 80. Conductor 88 also provides a feed back signal of the voltage level applied to the input face 28 (i.e., at metallization 28*a*) of the microchannel plate 22 into the voltage converter circuit 66. Note that this conductor 88 provides a reference voltage level of microchannel plate voltage on face 28, about which converter 66 regulates its outputs. The voltage converter 70 has connection to the screen 26 via a connection 70*a,* and provides a feed back of screen current level into ABC/BSP control circuit via conductor 94. Energy flow in the circuit 62 is provided by an oscillator 96 and coupled transformer 98, with output windings 98*a* providing energy input to voltage converters 66 and 70, and a conductor 100 providing energy to voltage converter 68. It is noted that the circuit 62 requires only the single transformer 98,.which advantageously reduces cost, size, weight, and parts count for the power supply; and also improves reliability for the power supply and night vision device 10. The oscillator 96 receives a control feed back via a regulator 102 and a feed back circuit 104, having an input from a feedback winding 98*b* of transformer 98.

Figure 4:
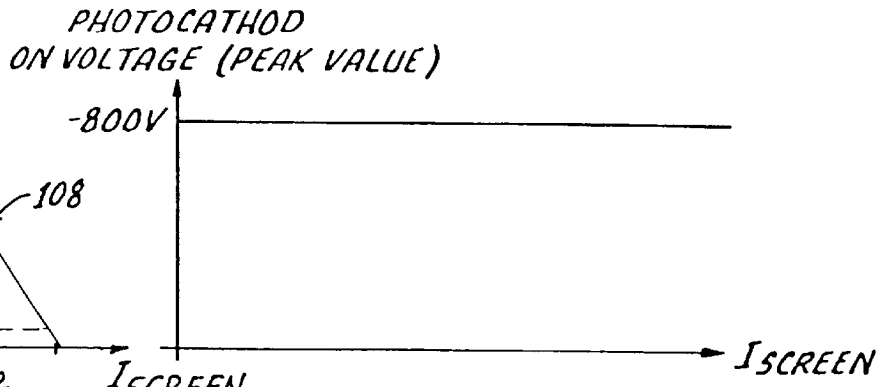
Figure 5:
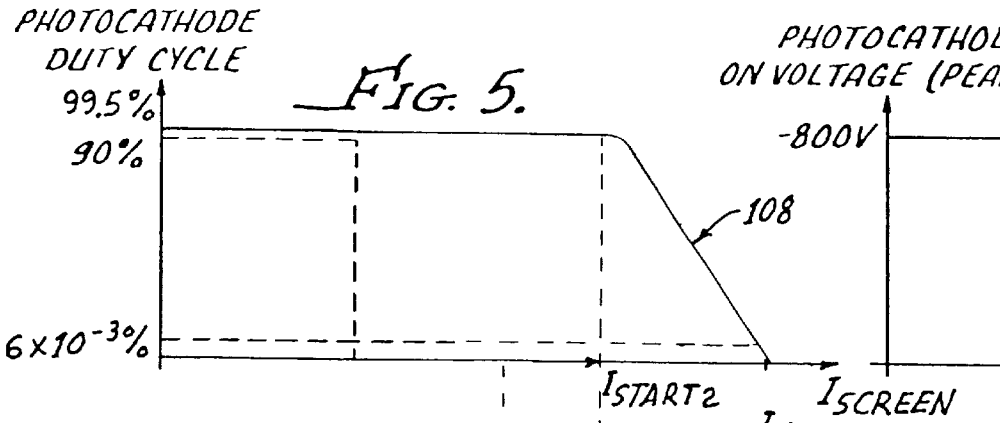

Having considered the structure of the circuit 66, attention may now be given to its operation, and the cooperation of this circuit operation with the operation of the $I^2T$ 14. Attention now to FIGS. 4–8, with attention first to FIG. 4, shows that the most negative voltage level produced by voltage converter 66*a* for application by power supply circuit 66 to the photocathode 20 of the tube 14 is always constant at a selected voltage level. Comparing this FIG. 4 to the voltage curve of FIG. 11 reveals that the prior art teaches to vary the voltage applied to the photocathode in order to provide a BSP function. However, FIG. 5 shows that the power supply circuit 66 provides a BSP function by keeping the voltage applied to the photocathode 20 constant (recalling FIG. 4) while gating connection of the photocathode between connection to this constant voltage source (i.e., about −800V with respect to the input face 28 of the MCP 22), to an open circuit (i.e., voltage off), and to a lower voltage i.e., relatively more positive relative to the face 28 of MCP 22—about +30V) provided by voltage converter 66*b* (simulating darkness for the photocathode 20). When the photocathode 20 is connected to voltage source 66*b* (i.e., to a source of about +30 volts relative to the face 28 of MCP 22), this condition might be considered a "hard turn off" for the photocathode. Under this condition, the photocathode is not responsive to photon received from the scene being viewed. This gating function is carried on at a constant cyclic rate and cycle interval, while varying the duty cycle of the applied constant voltage preferably as a function of current level sensed at screen 26 (i.e., by feed back over conductor 94).

It should be noted, however, that this gating function can be carried out with respect to other parameters of operation of the image intensifier tube 14. For example, an alternative way of controlling the gating function would be to use the current level at face 30 i.e., at electrode 30*a*) as a controlling parameter.

Figure 7:
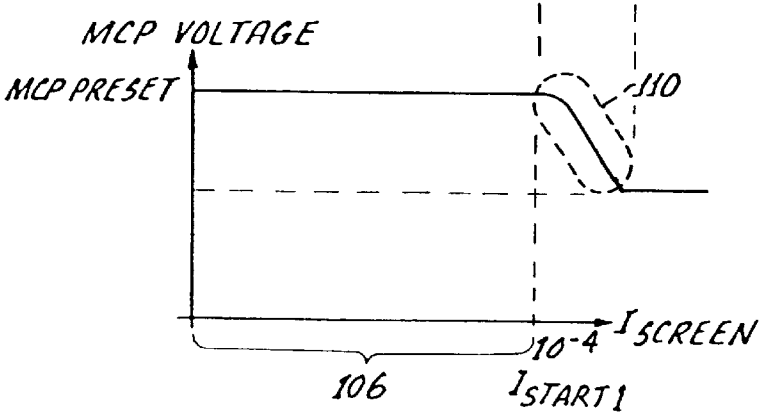

FIG. 5 shows that over a range of screen current indicated with the numeral 106, the duty cycle of the applied constant voltage to the photocathode 20 is fixed at substantially 100% and the voltage applied to the input face 28 of MCP 22 is at its full preset level. However, at screen current levels indicated by numeral 110 on FIG. 5, the MCP voltage decreases toward a predetermined value (typically around 350V lower than the preset value of MCP voltage, but it can be higher or lower depending on requirements of a given image tube type), while the duty cycle of the photocathode gating remains unchanged at substantially 100%. At screen current levels beyond the point at which the MCP voltage decrease of region 110 on FIG. 5 reaches its predetermined level, the duty cycle of photocathode voltage gating progressively ramps down substantially linearly, for example to a low level of essentially $6\times10^{-3}$% or lower, as a function of increasing screen current, as is indicated by numeral 108. It will be noted that FIGS. 5 and 7 are drawn to the same scale of screen current along the abscissa of the of the graph, and that these graphs are arranged one vertically above the other for the reader's convenience in understanding the relationship of photocathode gating duty cycle to voltage applied to the microchannel plate 22.

In this regard, the present invention maximizes the high light level image resolution while maintaining the signal-to-noise ratio (SNR) of the detector at an acceptably high level.

The reduction of voltage level applied across the microchannel plate 20 during region 110 on FIG. 5 is effected by action of the series element 82 increasing its resistance under control of MCP regulator 84. As noted this regulator 84 receives a summed input from the conductor 88 via the level adjusting resistor 90, and from the ABC/BSP control circuit 80, which itself is responsive to the level of current sensed at screen 26 by conductor 94.

Figure 9:
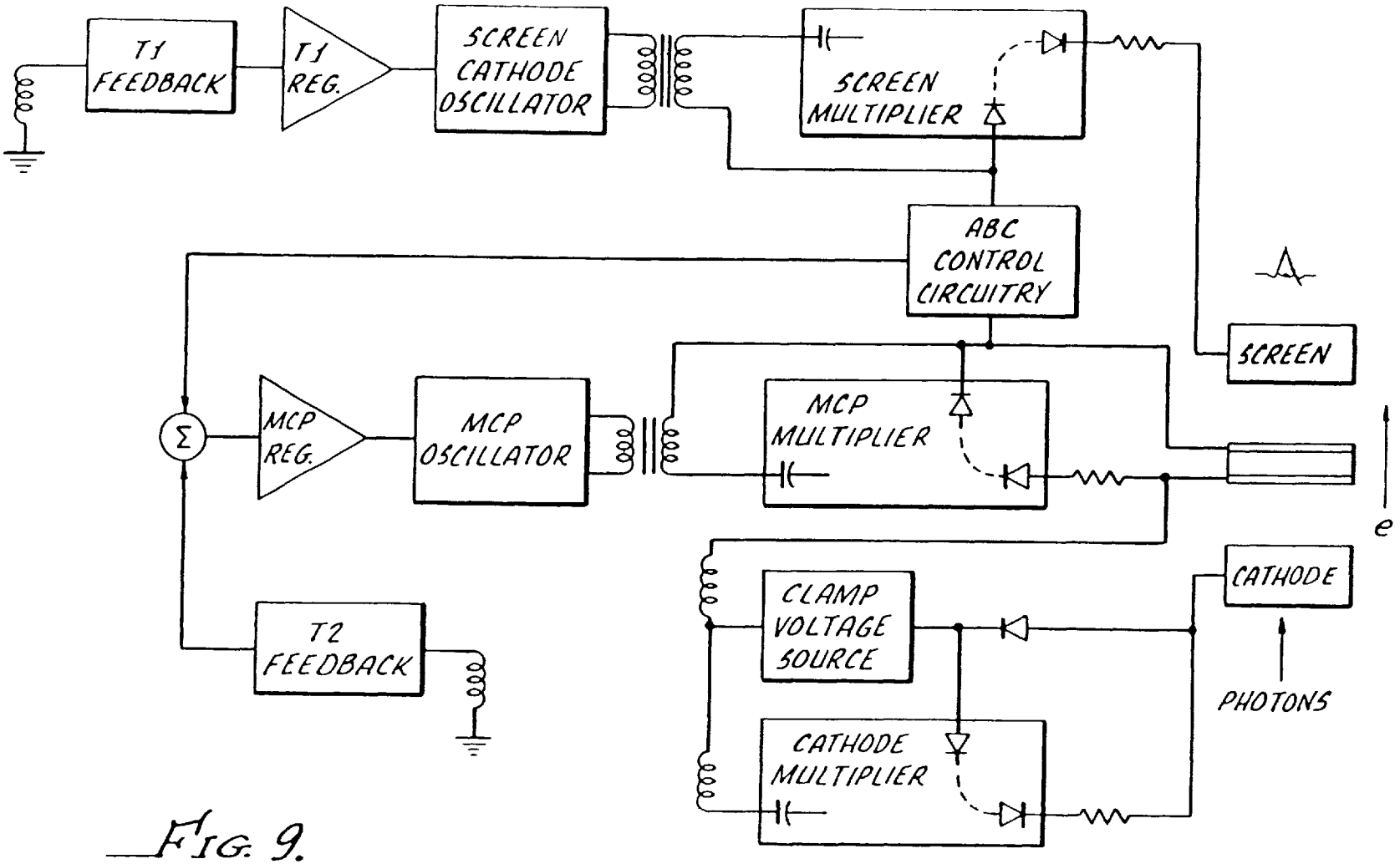
FIG. 9. (PRIOR ART)

Comparing this operation of power supply circuit 62 to the operation of the conventional power supply discussed above with reference to FIGS. 9–11, and viewing FIG. 10, it is seen that the power supply 62 avoids the problem of loss of resolution for an $I^2T$ caused in the conventional power supplies by operation with too low a voltage applied to the photocathode.

The voltage wave form of FIG. 6 might be produced by a rapid increase of light input such that MCP voltage reduction, and then the photocathode gating duty cycle reduction functions operate in succession. For this reason, FIG. 6 is also annotated with a time arrow, indicating that in this instance time proceeds from left to right on the graph. It will be noted that the constant voltage level gated to the photocathode 20 (i.e., from voltage converter 66*a*) is substantially −800V, while the positive voltage level from voltage converter 66*b* is about +30 volts relative to the face 28 (electrode 28*a*) of the microchannel plate 22. It should be noted that the value supplied by voltage converter 66*a* does not have to be −800V; it can be set to −600V, −400V, or any other value to accommodate the needs of the image tube.

The reader should not be confused by the similarity in appearance between the graph of FIG. 10 and that of FIG. 5, they are illustrating differing values. FIG. 10 relates to conventional microchannel plate voltage, while FIG. 5 is voltage gating duty cycle to the photocathode 20 as provided by the power supply 62.

In view of the above, attention now to FIG. 6 provides an understanding of the microchannel plate voltage level as the duty cycle for the application of the constant peak voltage seen in FIG. 4 is varied in response to changing light levels in the viewed scene, and in response to the changes in screen current level for the $I^2T$. FIG. 6 shows that portion of the duty cycle operation corresponding to portions 108 and 110 of FIGS. 5 and 7. Increasing light levels and increasing screen current levels go from left to right on the graph of FIG. 6. It will be noted that a portion of the graph of FIG. 6 is not shown (i.e., to the left of that part shown). This portion which is not shown would correspond to section 106 of FIG. 7, and in this realm of operation the duty cycle is always substantially 100%.

At the part of the graph of FIG. 6 near the region labeled $10^{-2}$ fc, it is seen that the duty cycle is here slightly less than 100%, and that within the interval for each duty cycle the voltage applied to photocathode 20 is initially the high constant peak voltage indicated in FIG. 4 (i.e., indicated at numerals 112), and then decays over a very short time interval at a natural open-circuit, capacitor-discharge rate (indicated at segments 114 of the voltage curve). This voltage decay is actually a very small voltage because of the short time interval, and occurs because the virtual capacitor existing between the photocathode 20 and the conductive metallization on the front light-receiving face of the microchannel plate 22 (i.e., conductive coating 28*a*) is open-circuit when the switching network 72 (recalling FIG. 3) is not conducting the photocathode to either voltage converter 66*a* or to voltage converter 66*b*. This virtual capacitor is diagrammatically indicated on FIG. 3, and indicated with the character "C". Next in each duty cycle, the network 72 conducts the photocathode to voltage converter 66*b*, which effectively replicates darkness for the photocathode 20 by dropping the voltage as is indicated at voltage cutoffs 116 of FIG. 6. Effectively, this dropping (i.e., more positive) voltage level for the photocathode 20 is a hard turn off. That is, when the applied voltage at the photocathode 20 is about +30 volts relative to the face 28 of microchannel plate 22, then electrons will not flow from this photocathode to the microchannel plate in response to photon of light hitting the photocathode. This voltage cutoff 116 is provided by having voltage converter 66*b* provide a voltage which is about 30 volts positive with respect to the voltage provided at coating 28*a* on the front face of the microchannel plate 22 by voltage converter 68.

Figure 8:
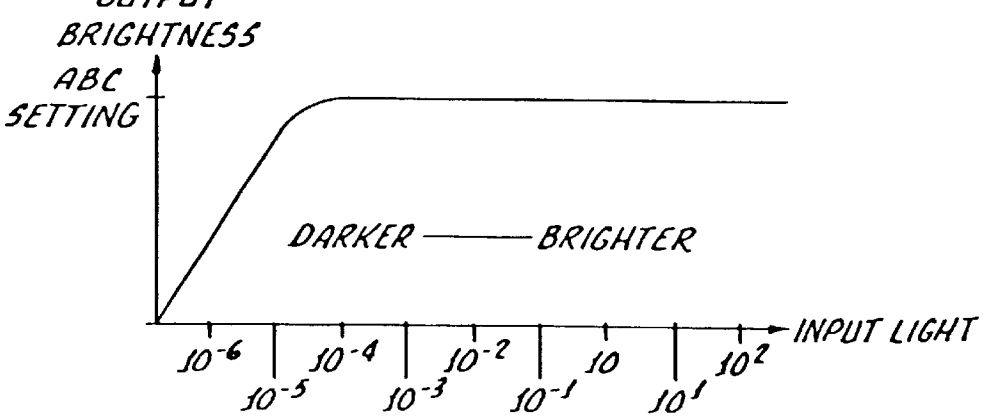

Restated, it is seen that in essence when the photocathode 20 operates, it always operates substantially at the high constant peak voltage seen in FIG. 4. When the photocathode 20 is not operating, it is switched to a voltage which replicates a dark field for the photocathode (i.e., the +30 volts from voltage converter 66*b*). The photocathode 20 operated by the power supply 62 of the present invention is switched between operation at its designed voltage level and dark-field condition at a duty cycle which varies dependent upon the light intensity of the scene being viewed, as indicated by current flow at the screen 26. This function is carried out in accord with the duty cycle function indicated in FIG. 5 in order to provide ABC. The result of this ABC operation is illustrated in FIG. 8, which indicates that over a broad range of input light levels, a substantially constant brightness for the image presented to a user of the night vision device 10 is achieved. At the left-hand side of FIG. 8 is seen a linearly decreasing section of the brightness curve from the image intensifier tube 14. This occurs with very dim lighting levels, but the image intensifier tube 14 will still provide a usable image in at least a portion of this regime of its operation.

Returning to consideration of FIGS. 5 and 7, within section 110, the MCP voltage is decreased to a predetermined level while the photocathode gating duty cycle remains constant at substantially 100%. As the light level of the viewed scene continues to increase, the duty cycle is progressively decreased until it reaches it low level of $6\times10^{-3}$% as a function of increasing screen current which, in the present design, would provide regulation of the I2T output for input light levels up to 100 fc.

The above examples of an image intensifier tube for a night vision device are also applicable to any sort of similar detector used to amplify electromagnetic radiation having a microchannel plate (MCP).

Those skilled in the art will appreciate that the embodiment of the present invention depicted and described herein and above is not exhaustive of the invention For example, the ABC and BSP aspects of the invention may be implemented separately of one another if desired. Those skilled in the art will further appreciate that the present invention may be embodied in other specific forms without departing from the spirit or central attributes thereof. Because the foregoing description of the present invention discloses only an exemplary embodiment thereof, it is to be understood that other variations are recognized as being within the scope of the present invention. Accordingly, the present invention is not limited to the particular embodiment which has been described in detail herein. Rather, reference should be made to the appended claims to define the scope and content of the present invention.

What is claimed is:

1. A night vision device having an objective lens receiving light from a scene being viewed and directing this light to an image intensifier tube, said image intensifier tube providing a visible image of the scene being viewed, and an eyepiece lens providing this visible image to a user of the night vision device; said image intensifier tube including a photocathode receiving photons from the scene and releasing photoelectrons in a pattern replicating the scene, a microchannel plate receiving the photoelectrons and providing a shower of secondary emission electrons in a pattern replicating the scene, and a receiver element for receiving the shower of secondary emission electrons and producing a visible image replicating the scene with a resulting brightness; said night vision device including a source of electrical power at a selected voltage level, and a power supply circuit receiving said electrical power at said selected voltage level to responsively provide electrical power at higher voltage levels to said photocathode, to an input and opposite output faces of said microchannel plate, and to said receiver, said power supply circuit including a pair of voltage converter circuits each providing a differing non-zero voltage level to said photocathode with respect to the input face of the microchannel plate, one of said pair of voltage converter circuits providing a positive voltage with respect to the microchannel input face and the second of said pair of voltage converter circuits providing a negative voltage with respect to the input face of the microchannel plate, a switching network connecting said photocathode alternatingly to one of said pair of voltage converter circuits and to the other of said pair of voltage converter circuits, the photocathode having a duty cycle being connected to the negative voltage converter and being varied based on a receiver current related to the receiver image brightness, and the microchannel plate voltage being reduced prior to a reduction in the duty cycle of the photocathode, whereby the output brightness of the receiver image is regulated.

2. The night vision device of claim 1 wherein said power supply includes only a single transformer.

3. The night vision device of claim 1 wherein said switching network connects said photocathode to open circuit after connection to the more negative one of said pair of voltage converter circuits.

4. The night vision device of claim 3 further including a duty cycle controller controlling said switching network in response to a current level at said receiver.

5. The night vision device of claim 4 wherein said duty cycle controller includes a gating trigger signal generator, and a control circuit receiving a gating signal from said gating trigger signal generator and providing an output signal controlling said switching network.

6. The night vision device of claim 1 further including another voltage converter circuit providing a selected voltage level to said opposite faces of said microchannel plate, and a voltage control element in series connection between said another voltage converter circuit and the output face of said microchannel plate.

7. An enhanced detector comprising:

an image intensifier tube of the type having an input end and an output end, a photocathode, a microchannel plate coupled to the photocathode, and a receiver element for receiving secondary emission electrons from the microchannel plate and producing a visible image replicating the scene with a resulting brightness;

a power supply circuit responsively provides electrical power to said photocathode, and to an input and opposite output faces of said microchannel plate, said power supply circuit including a pair of voltage converter circuits each providing a differing non-zero voltage level to said photocathode with respect to the input face of the microchannel plate, one of said pair of voltage converter circuits providing a positive voltage with respect to the microchannel input face and the second of said pair of voltage converter circuits providing a negative voltage with respect to the input face of the microchannel plate;

a switching network connecting said photocathode alternatingly to one of said pair of voltage converter circuits and to the other of said pair of voltage converter circuits; and, the photocathode having a duty cycle being connected to the negative voltage converter and being varied based on a receiver current related to the receiver image brightness, and the microchannel plate voltage being reduced prior to a reduction in the duty cycle of the photocathode;

whereby the output brightness of the receiver image is regulated.

8. The detector of claim 7 wherein said power supply includes only a single transformer.

9. The detector of claim 7 wherein said switching network connects said photocathode to open circuit after connection to the more negative one of said pair of voltage converter circuits.

10. The detector of claim 9 further including a duty cycle controller controlling said switching network in response to a current level at said receiver.

11. The detector of claim 10 wherein said duty cycle controller includes a gating trigger signal generator, and a control circuit receiving a gating signal from said gating trigger signal generator and providing an output signal controlling said switching network.

12. The detector of claim 7 further including another voltage converter circuit providing a selected voltage level to said opposite faces of said microchannel plate, and a voltage control element in series connection between said another voltage converter circuit and the output face of said microchannel plate.

13. The detector of claim 7 further including the steps of maintaining said variable duty cycle at substantially 100% over a first range of receiver current, and progressively decreasing said duty cycle from 100% to a lower level over a second range of receiver current.

14. The detector of claim 13 wherein said lower level is selected to be substantially $6\times10^{-3}\%$.

15. The detector of claim 13 wherein said lower level is selected to maximize high light level image resolution while maintaining a signal to noise ratio of the detector at a selected high level.

16. A power supply for an enhanced detector of the type having an input end and an output end, a photocathode, a microchannel plate coupled to the photocathode, and a receiver element for receiving secondary emission electrons from the microchannel plate and producing a visible image replicating the scene with a resulting brightness, the power supply comprising:

a power supply circuit responsively provides electrical power to the photocathode, and to an input and opposite output faces of the microchannel plate, said power supply circuit including a pair of voltage converter circuits each providing a differing non-zero voltage level to the photocathode with respect to the input face of the microchannel plate, one of said pair of voltage converter circuits providing a positive voltage with respect to the microchannel input face and the second of said pair of voltage converter circuits providing a negative voltage with respect to the input face of the microchannel plate;

a switching network connecting said photocathode alternatingly to one of said pair of voltage converter circuits and to the other of said pair of voltage converter circuits; and, the photocathode having a duty cycle being connected to the negative voltage converter and being varied based on a receiver current related to the receiver image brightness, and the microchannel plate voltage being reduced prior to a reduction in the duty cycle of the photocathode;

whereby the output brightness of the receiver image is regulated.

17. The power supply of claim 16 wherein said power supply includes only a single transformer.

18. The power supply of claim 16 wherein said switching network connects said photocathode to open circuit after connection to the more negative one of said pair of voltage converter circuits.

19. The power supply of claim 18 further including a duty cycle controller controlling said switching network in response to a current level at said receiver.

20. The power supply of claim 19 wherein said duty cycle controller includes a gating trigger signal generator, and a control circuit receiving a gating signal from said gating trigger signal generator and providing an output signal controlling said switching network.

21. The power supply of claim 16 further including another voltage converter circuit providing a selected voltage level to said opposite faces of said microchannel plate, and a voltage control element in series connection between said another voltage converter circuit and the output face of said microchannel plate.

22. The power supply of claim 16 further including the steps of maintaining said variable duty cycle at substantially 100% over a first range of receiver current, and progressively decreasing said duty cycle from 100% to a lower level over a second range of receiver current.

23. The power supply of claim 22 wherein said lower level is selected to be substantially $6\times10^{-3}\%$.

24. The power supply of claim 22 wherein said lower level is selected to maximize high light level image resolution while maintaining a signal to noise ratio of the detector at a selected high level.

25. A method of operating a detector, the detector of the type including an photocathode receiving photons and releasing photoelectrons, a microchannel plate receiving the photoelectrons at an input face and providing secondary emission electrons from an output face, and a receiver element for receiving the secondary emission electrons; said method including steps of:

providing a non-zero positive voltage level with respect to the input face of the microchannel plate and available to be switched to said photocathode;

providing a non-zero negative voltage level with respect to the output face of the microchannel plate;

in a variable duty cycle switching said photocathode alternatingly from said negative voltage level and said relative positive voltage level;

varying a duty cycle of the photocathode being connected to the negative voltage converter based on a receiver current related to the image brightness from the receiver; and reducing microchannel plate voltage prior to a reduction in the duty cycle of the photocathode;

whereby the output brightness of the receiver image is regulated.

26. The method of claim 25 further including the steps of maintaining said variable duty cycle at substantially 100% over a first range of receiver current, and progressively decreasing said duty cycle from 100% to a lower level over a second range of receiver current.

27. The method of claim 26 wherein said lower level is selected to be substantially $6\times10^{-3}\%$.

28. The method of claim 26 wherein said lower level is selected to maximize high light level image resolution while maintaining a signal to noise ratio of the detector at a selected high level.

* * * * *